United States Patent [19]

Mendenhall et al.

[11] Patent Number: 4,881,901

[45] Date of Patent: Nov. 21, 1989

[54] HIGH DENSITY BACKPLANE CONNECTOR

[75] Inventors: David W. Mendenhall, Greenville, R.I.; Steve P. Marian, Plainville, Mass.; Jay T. Goff, Cranston, R.I.; Neil J. Cotter, Marston Mills, Mass.; Steve R. Corbesero, Johnston, R.I.

[73] Assignee: Augat Inc., Mansfield, Mass.

[21] Appl. No.: 246,777

[22] Filed: Sep. 20, 1988

[51] Int. Cl.[4] ..... H01R 9/09; H01R 23/70

[52] U.S. Cl. ..... 439/65; 439/67; 439/260; 439/629

[58] Field of Search ..... 439/52, 65, 67, 260, 439/263-265, 629, 95

[56] References Cited

U.S. PATENT DOCUMENTS

| | | | |
|---|---|---|---|
| 3,715,706 | 2/1973 | Michel et al. | 439/65 |
| 3,853,382 | 12/1974 | Lazar | 339/95 R |
| 4,288,140 | 9/1981 | Griffith et al. | 339/74 R |
| 4,420,203 | 12/1983 | Aug et al. | 339/17 CF |
| 4,517,625 | 5/1985 | Frink et al. | 361/399 |
| 4,518,210 | 5/1985 | Morrison | 339/17 LM |
| 4,538,866 | 9/1985 | Johnson | 339/17 LM |
| 4,540,227 | 9/1985 | Faraci | 339/17 F |
| 4,540,228 | 9/1985 | Steele | 339/74 R |
| 4,585,288 | 4/1986 | Aikens | 439/629 |
| 4,597,619 | 7/1986 | Reimer | 339/75 MP |
| 4,629,270 | 12/1986 | Andrews, Jr. et al. | 339/75 MP |
| 4,693,529 | 9/1987 | Stillie | 439/67 |
| 4,744,764 | 5/1988 | Rubenstein | 439/260 |

*Primary Examiner*—P. Austin Bradley

*Attorney, Agent, or Firm*—Weingarten, Schurgin, Gagnebin & Hayes

[57] ABSTRACT

A high density backplane (HDB) connector is provided for electrically interconnecting high density printed circuit boards. The printed circuit boards have a predetermined geometric conductive pattern which includes high density arrays of individual signal/power contact interconnects and unitary ground strips. The HDB connector comprises a housing module secured to one board and a stiffener module secured to a second board. A compliant contact module mounted within the housing module includes a resilient member, an insulator member having arrays of free-floating rigid contact pins disposed therein, and a flexile film interposed therebetween. The flexile film has a signal/power conductive matrix formed on one side and a continuous ground plane formed on the other side. The compliant contact module further includes prestressed early-mate ground contacts and a plurality of distributed resilient ground contacts. Circuit board mating is effected by pressing the stiffener module down onto the housing module. The prestressed early-mate ground contacts exert forces to bias the second board away from the rigid contact pins. Further downward movement of the stiffener module causes a camming coaction between the stiffener module and the housing module to urge the second board into mating engagement with the rigid contact pins and the distributed resilient ground contacts. Final downward movement of the stiffener effects a wiping action between contact interconnects.

10 Claims, 6 Drawing Sheets

HIGH DENSITY BACKPLANE CONNECTOR

HIGH DENSITY BACKPLANE CONNECTOR

FIELD OF THE INVENTION

The present invention relates generally to connectors for electrically interconnecting printed circuit boards, and more particularly to a high density electrical connector including a housing module and a stiffener module which cammingly coact to effect mating engagement between printed circuit boards secured thereto and a compliant contact module which biases free-floating rigid contact pins into engagement with the printed circuit boards.

BACKGROUND OF THE INVENTION

The effectiveness and performance of printed circuit boards are continually being upgraded by the use of more complex solid state circuit technology, the use of higher frequency operating signals to improve circuit response times and by increasing the circuit density of the boards. The upgrade in printed circuit board technology, in turn, has placed more stringent requirements upon the design of electrical connectors. The need exists for electrical connectors having increased input/output densities and decreased contact interconnect spacing, improved electrical performance, high mechanical integrity, improved reliability and greater flexibility. Additionally, the electrical connectors should be adapted for surface mount technology and for effecting printed circuit board mating with low insertion forces.

Prior art electrical connectors for electrically interconnecting printed circuit boards have traditionally been fabricated using stamped and formed contacts and molded dielectrical material. These prior art electrical connectors have been limited to contact interconnect spacing on the order of 40 contact interconnects per linear inch. In addition, prior art contact interconnect matrices have been formed as distributed pluralities of signal, ground and power contact interconnects, typically in a ratio of 6:3:1, respectively.

For example, if a particular application requires 300 signal contact interconnects, the contact interconnect matrix must be formed to have 500 contact interconnects since 150 ground contact interconnects and 50 power contact interconnects are required. With a contact interconnect density of 40 contact interconnects/linear inch, a single row of 500 distributed signal, ground and power contact interconnects would occupy 12.50 linear inches of board space, thus limiting the input/output density of the electrical connector.

To satisfy the input/output densities required by present day circuit board technology, contact interconnect spacing on the order of 80 contact interconnects/linear inch is required. While electrical connectors are available which have contact interconnect spacing on the order of 80 contact interconnects per linear inch, these electrical connectors utilize interconnect matrices having distributed signal, ground and power contact interconnects. Thus, even electrical connectors having contact interconnect spacing on the order of 80 contact interconnects per linear inch provide only a limited increase in input/output density. For example, a single row of 500 distributed signal, ground and power contact interconnects would occupy 6.25 linear inches of board space.

Higher frequency signals are increasingly being utilized with printed circuit boards to improve the response time of the circuits. The use of higher frequency signals, however, presents additional design constraints upon designers of electrical connectors. The frequency response curve for low to middle frequency signals is illustrated in FIG. 1A wherein $t_r$ represents the rise time of the signal, $t_s$ represents the settling time of the signal, $t_{ss}$ represents the steady state or operational condition of the signal, and $t_f$ represents the fall time of the signal. To increase circuit performance, $t_r$ and $t_s$ should be minimized to the extent practicable.

One means of improving circuit performance is by reducing the $t_r$ of the signal. Higher frequency signals improve the response time of a circuit by significantly reducing $t_r$. A typical signal response curve for a high frequency signal is illustrated in FIG. 1B. The high frequency signal has a $t_r$ approximately one order of magnitude lower than a low frequency signal, i.e., 5 nanoseconds versus 0.30 nanoseconds. As will be apparent from an examination of FIG. 1B, however, higher frequency signals may have a relatively longer $t_s$ due to impedance mismatches and/or discontinuities in the signal conducting paths. Therefore, a prime concern in designing electrical connectors is to ensure matched impedances between the electrical connector and the contact interconnects of the mated printed circuit boards and signal path integrity in the electrical connector.

A further problem area for electrical connector is the effect of contamination and/or oxidation on contact interconnects. Concomitant with an increase in input/output density of contact interconnects is the decrease in size of the contact interconnects. The reduction in size of the contact interconnects aggravates the detrimental effects of contamination and/or oxidation of the contact interconnects such as increased contacting resistances and distortion of electrical signals. Therefore, an effective electrical connector should have the capability of providing a wiping action between the contact interconnects of the printed circuit boards and the electrical connector.

The use of flexile film having preformed contact interconnects and interconnecting circuit traces is known in the art. Electrical connectors must be capable of effecting repetitive connections/disconnections between printed circuit boards. Repetitive connections/disconnections cause repetitive wiping action of the contact interconnects which may cause an undesirable degradation in the mechanical and electrical characteristics of the contact interconnects and/or the integrity of the signal paths of the electrical connector and/or printed circuit boards.

Finally, electrical connectors require some mechanical means for camming to provide the capability for printed circuit board mating with low insertion mating forces and to effect the wiping action between the contact interconnects. Ideally, the camming means should be a simple mechanical configuration and easily operated, thereby reducing the costs and time attributed to the manufacture and/or assemblage electrical connector. Representative camming mechanisms are shown in U.S. Pat. Nos. 4,629,270, 4,606,594 and 4,517,625. An examination of these patents reveals that the camming mechanisms disclosed therein are relatively complex mechanical devices requiring the fabrication and assemblage of a multitude of components. While these camming mechanisms may be functionally effective to provide a wiping action between contact interconnects, such camming mechanisms are relatively bothersome to fabricate and assemble. In addition, complex camming mechanisms significantly reduce the reliability and flexibility of the electrical connector.

SUMMARY OF THE INVENTION

The present invention is directed to a high density backplane (HDB) connector which provides a high contact interconnect spacing per linear inch, maintains signal path integrity, significantly reduces or eliminates signal settling time by providing matched impedance between printed circuit boards and provides a wiping action between contact interconnects of the electrical connector and the printed circuit board to be mated. The HDB connector of the present invention provides an effective and reliable camming structure which is simple to fabricate, assemble and operate. The HDB connector of the present invention also greatly reduces or eliminates mechanical wear on the flexile film conductive matrix.

The HDB connector of the present invention includes a two section housing module adapted to be secured to a motherboard, a compliant contact module mounted within the housing module and a stiffener module adapted to be secured to a daughterboard. The motherboard and daughterboard have predetermined geometric conductive patterns which include distributed signal/power contact interconnects and unitary ground strips.

A camming effect is provided by coaction between selected elements of the compliant contact module, the housing module and the stiffener module during mating. The selected elements are formed as integral structural features of the housing module and the stiffener. In one embodiment the selected elements include prestressed early-mate ground contacts of the compliant contact module, a sidewall and complimentary camming member integrally formed with an upper section of the housing module and a sidewall of the stiffener module having spaced apart tapered and planar camming surfaces integrally formed thereon.

The compliant contact module of the present invention includes an insulator member having a first and second plurality of free-floating rigid contact pins disposed therein, a resilient member which exerts biasing forces on the free-floating rigid contact pins, and a flexile film interposed between the resilient member and the insulator member. The compliant contact module further includes a pair of S-shaped ground strips, one of which has end portions formed as a pair of spaced apart, prestressed early-mate ground contacts and a plurality of distributed resilient ground contacts.

A conductive matrix is formed on one major surface of the flexile film. The conductive matrix includes first and second arrays of signal/power contact interconnects and corresponding interconnecting conductive traces. A contiguous ground plane is formed on the other major surface of the flexile film.

Prior to mating, the housing module is assembled and secured to the motherboard. The housing module is assembled by mounting the compliant contact module in a lower section of the housing module, mating the upper section to the lower section, and securing the assembled configuration to the motherboard. The stiffener module is secured to the daughterboard.

Mating of the daughterboard to the motherboard is effected by initially pressing the stiffener module downwardly over the housing module. The prestressed early-mate ground contacts sequentially engage the daughterboard and portions of the unitary ground strip to bias the daughterboard away from the housing module such that the contact interconnects thereof move freely past noncorresponding rigid contact pins.

Further downward movement of the stiffener module causes camming coaction between the sidewalls of the stiffener module and the housing module. The camming coaction is sufficient to overcome the biasing force exerted by the prestressed early-mate ground contacts, thereby causing the contact interconnects of the daughterboard to be displaced into engagement with corresponding rigid contact pins.

A final very small downward displacement of the stiffener module completes the mating process. The final downward displacement effects a wiping action between corresponding contact interconnects and rigid contact pins. The biasing forces exerted by the prestressed early-mate ground contacts and the distributed resilient ground contacts and the corresponding reactive forces between the engaged camming elements maintains the daughterboard in mated engagement with the motherboard. The biasing forces exerted by the resilient member maintains corresponding contact interconnects and rigid contact pins in good mechanical and electrical engagement.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENT

Figure 1A:
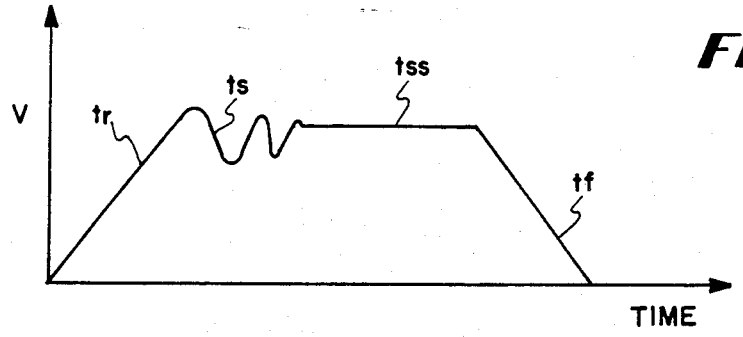
FIGS. 1A, 1B are representative signal response curves.
Figure 1B:
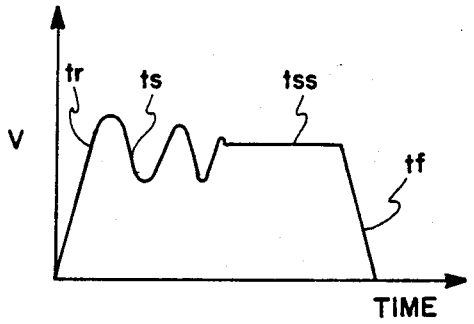
Figure 3B:
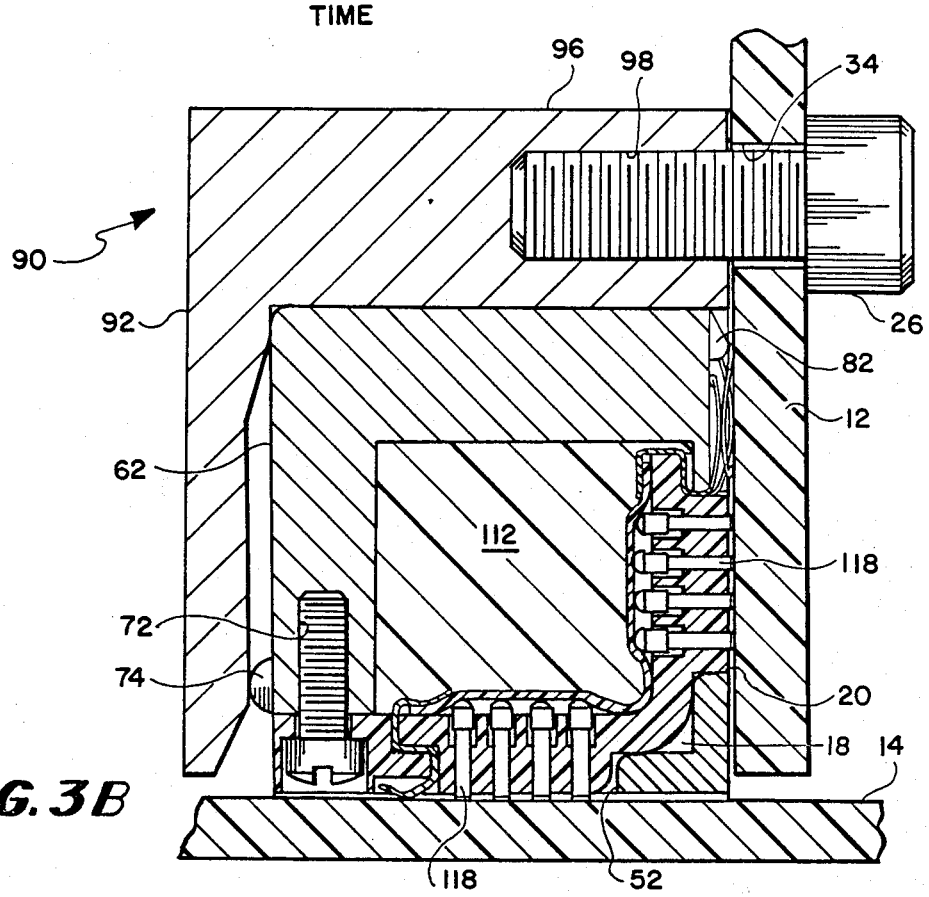
FIG. 3B is a cross-sectional view of the high density backplane connector of FIG. 2 in a mated condition.
Figure 2:
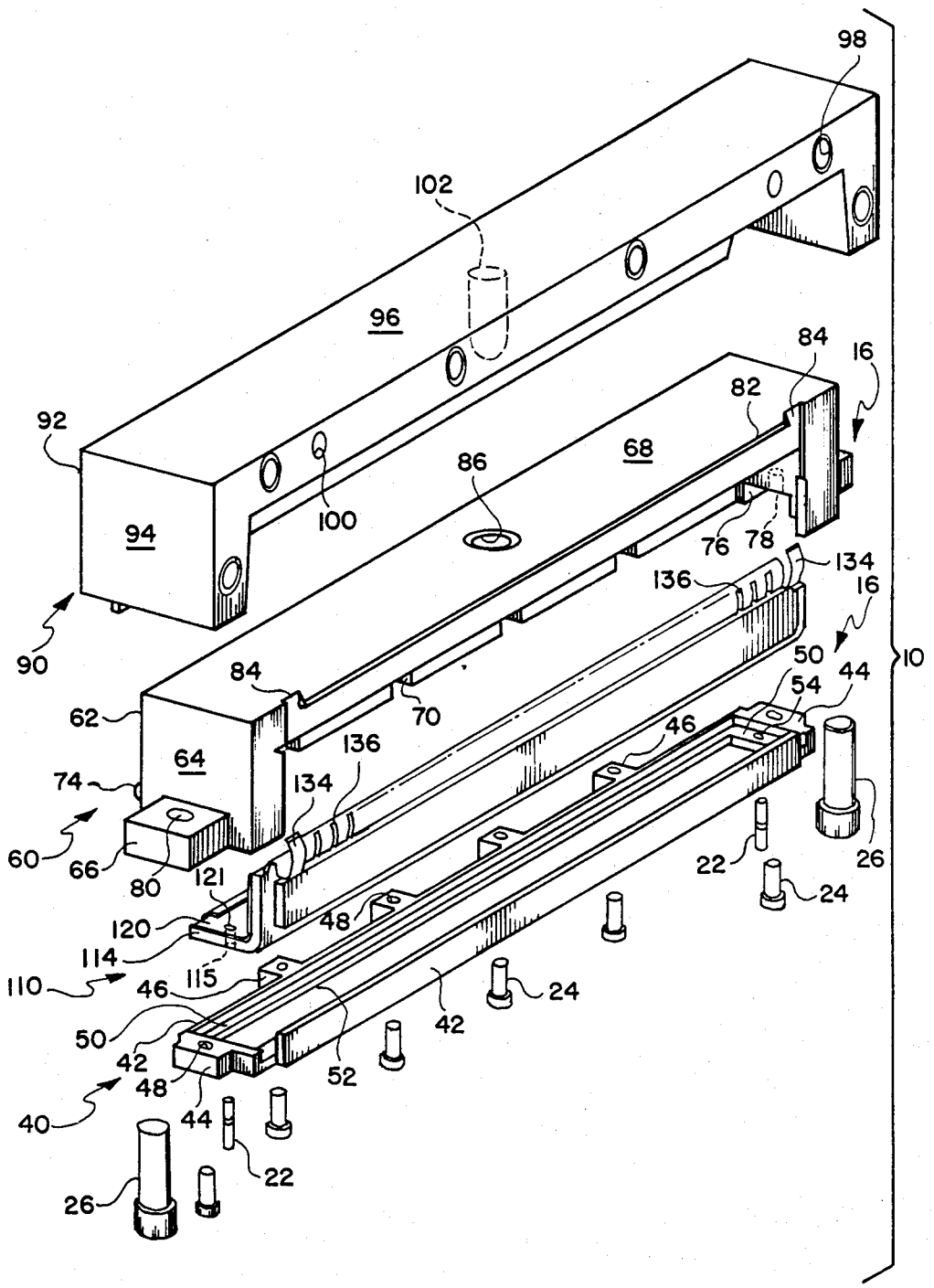
FIG. 2 is an exploded perspective view of a high density backplane connector according to the present invention.
Figure 3A:
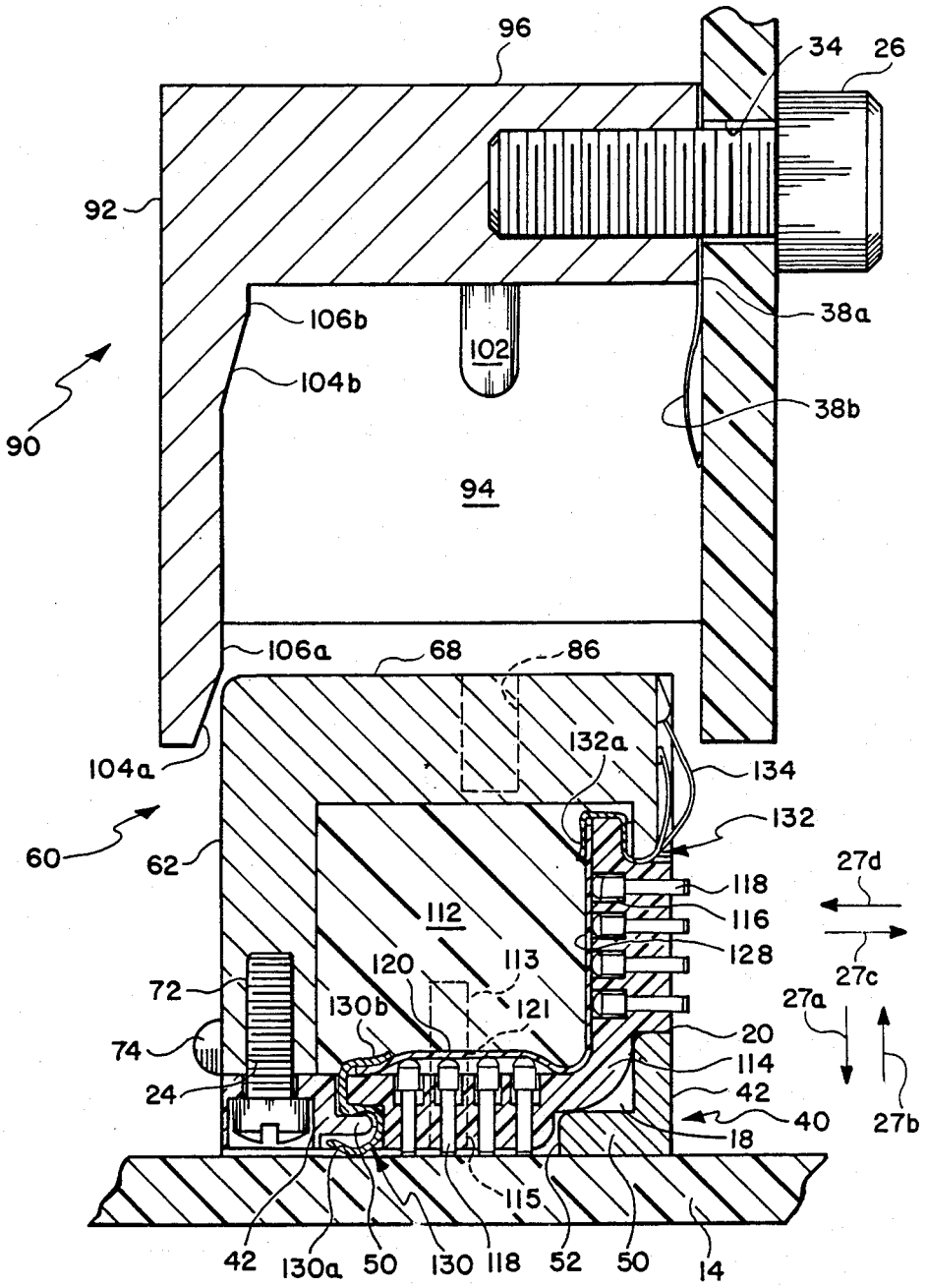
FIG. 3A is a cross-sectional view of the high density backplane connector of FIG. 2 in an unmated condition.

Referring now to the drawings wherein like numerals designate corresponding or similar elements throughout the several views, there is shown in FIG. 2 in exploded perspective of an exemplary high density backplane (HDB) connector 10 according to the present invention for electrically 6 interconnecting a daughterboard 12 to a backplane or motherboard 14 (see FIGS. 3A, 3B). The daughterboard 12 and the motherboard 14 each include predetermined geometric conductive patterns for electrical interconnection to external circuits (see FIGS.

5B, 5C). The HDB connector 10 includes a housing module 16 adapted to be secured to the motherboard 14, a compliant contact module 110 mounted within the housing module 16, and a stiffener module 90 adapted to be secured to the daughterboard 12.

The housing module 16 may be fabricated from an insulating material such as plastic. Alternatively, the housing module 16 may be fabricated from a structurally rigid material such as aluminum. The stiffener module 90 is preferably made from a structurally rigid material such as aluminum.

The housing module 16 includes a lower section 40 adapted to be interfaced with the motherboard 14. The lower section 40 includes sidewalls 42, 42, flanged endwalls 44, 44 and one or more mating tabs 46 projecting outwardly from one of the sidewalls 42. Each of the flanged endwalls 44, 44 and the mating tabs 46 has a hole 48 formed therethrough. A support shoulder 50 projecting inwardly from the sidewalls 42, 42 and the flanged endwalls 44, 44 is adapted for mounting the compliant contact module 110 within the housing module 16, as discussed in greater detail hereinbelow. The inner periphery of the support shoulder 50 defines a motherboard window 52 which interfaces with the motherboard 14. Each of the sections of the support shoulder 50 adjacent the flanged endwalls 44, 44 has a registration hole 54 formed therethrough.

The housing module 16 further includes an upper section 60 adapted to be mated to the lower section 40. The upper section 60 includes a sidewall 62, endwalls 64, 64 having securing tabs 66 projecting therefrom, and a top wall 68. One or more mating recesses 70 are formed in the sidewall 62 to mate with corresponding mating tabs 46 of the lower section 40. Bores 72 are formed in the sidewall 62 from each mating recess 70. A complimentary camming member 74 is integrally formed on the sidewall 62 and extends along the length thereof.

Contiguous cavities 76 are formed in the endwalls 64, 64 and securing tabs 66, 66 to receive the flanged endwalls 44, 44 of the lower section 40. Registration bores 78 are formed in the endwalls 64, 64 from the cavities 76. Securing bores 80 are formed in the securing tabs 66, 66.

An overhang 82 is formed on the edge of the top wall 68 opposite the sidewall 62 and extends substantially the length of the top wall 68. The overhang 82 in combination with the endwalls 64, 64 forms two spaced-apart contact channels 84, 84. An alignment slot 86 is formed in the top wall 68.

The housing module 16 is formed by mating the lower and upper sections 40, 60 together as discussed hereinbelow. The internal volume of the housing module 16 defines a compliant contact module chamber 18. A daughterboard window 20 is formed by the sidewall 42 of the lower section 40 and the endwalls 64, 64 and edge of the top wall 68 of the upper section 60.

The stiffener module 90 is adapted to be rigidly secured to the daughterboard 12 and includes a sidewall 92, endwalls 94, 94 and a top wall 96. Securing bores 98 are formed in the edges of the endwalls 94, 94 and the top wall 96. Securing screws 26 are then inserted through securing apertures 34 (see FIG. 4A) in the daughterboard 12 from the non-mating side thereof into engagement with the securing bores 98 to secure the stiffener module 90 to the daughterboard 12.

One or more registration holes 100 may also formed in the edge of the top wall 96. Registration pins 22 are inserted in pilot holes (not shown) in the daughterboard 12 to protrude from the mating side thereof and are inserted into the registration holes 100 to ensure proper alignment between the stiffener module 90 and the daughterboard 12 during mating. An alignment post 102 is formed to protrude outwardly from the inner surface of the top wall 96.

Referring to FIG. 3A, the internal surface of the sidewall 92 is configured for camming and engaging coaction with the upper section 60 of the assembled housing module 16. The internal surface of the sidewall 92 includes first and second tapered camming surfaces **104*a*, 104*b* and first and second engaging surfaces 106*a*, 106*b***.

Figure 4A:
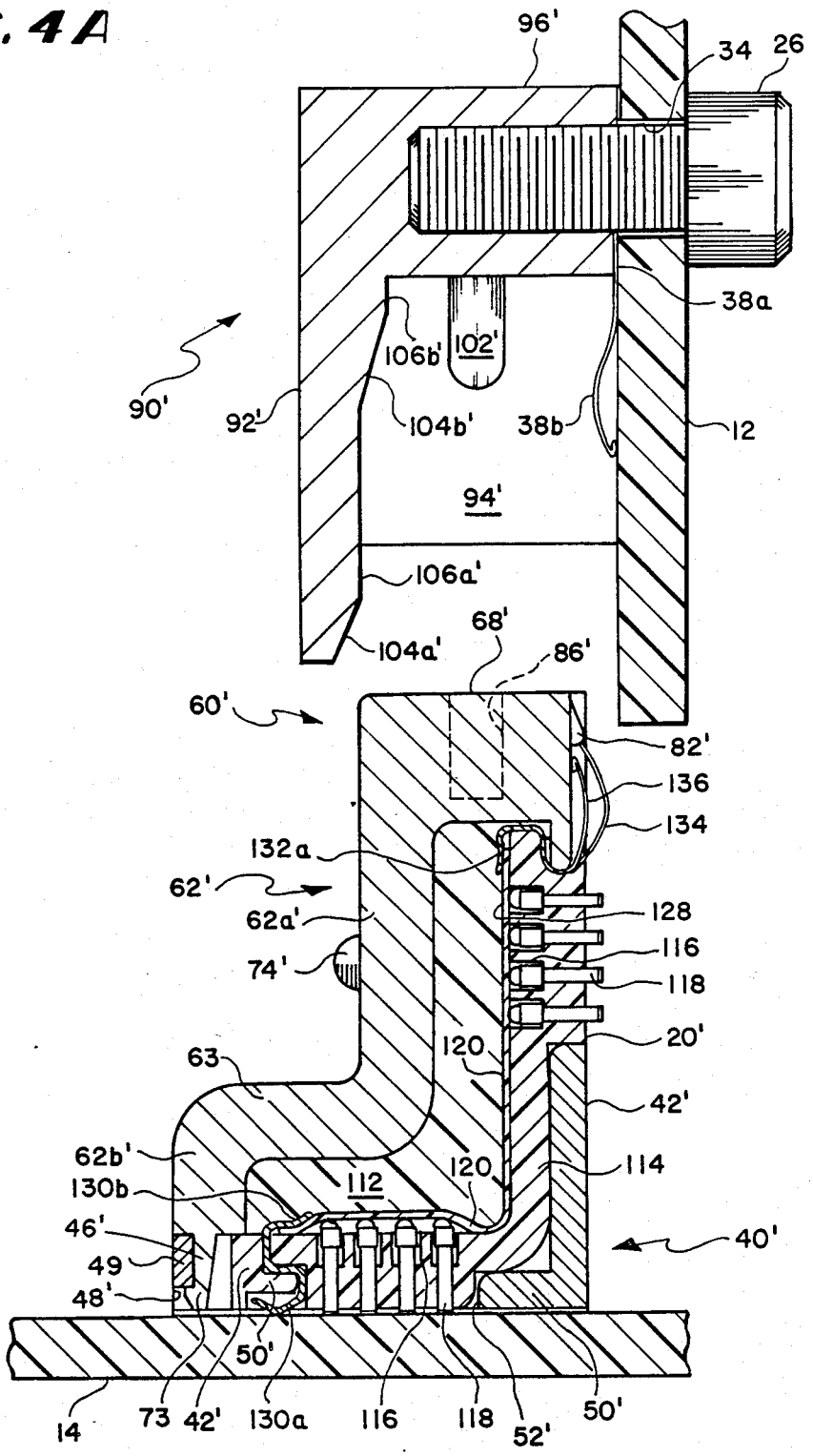
FIG. 4A is a cross-sectional view of an alternative embodiment of a high density backplane connector according to the present invention in an unmated condition.
Figure 4B:
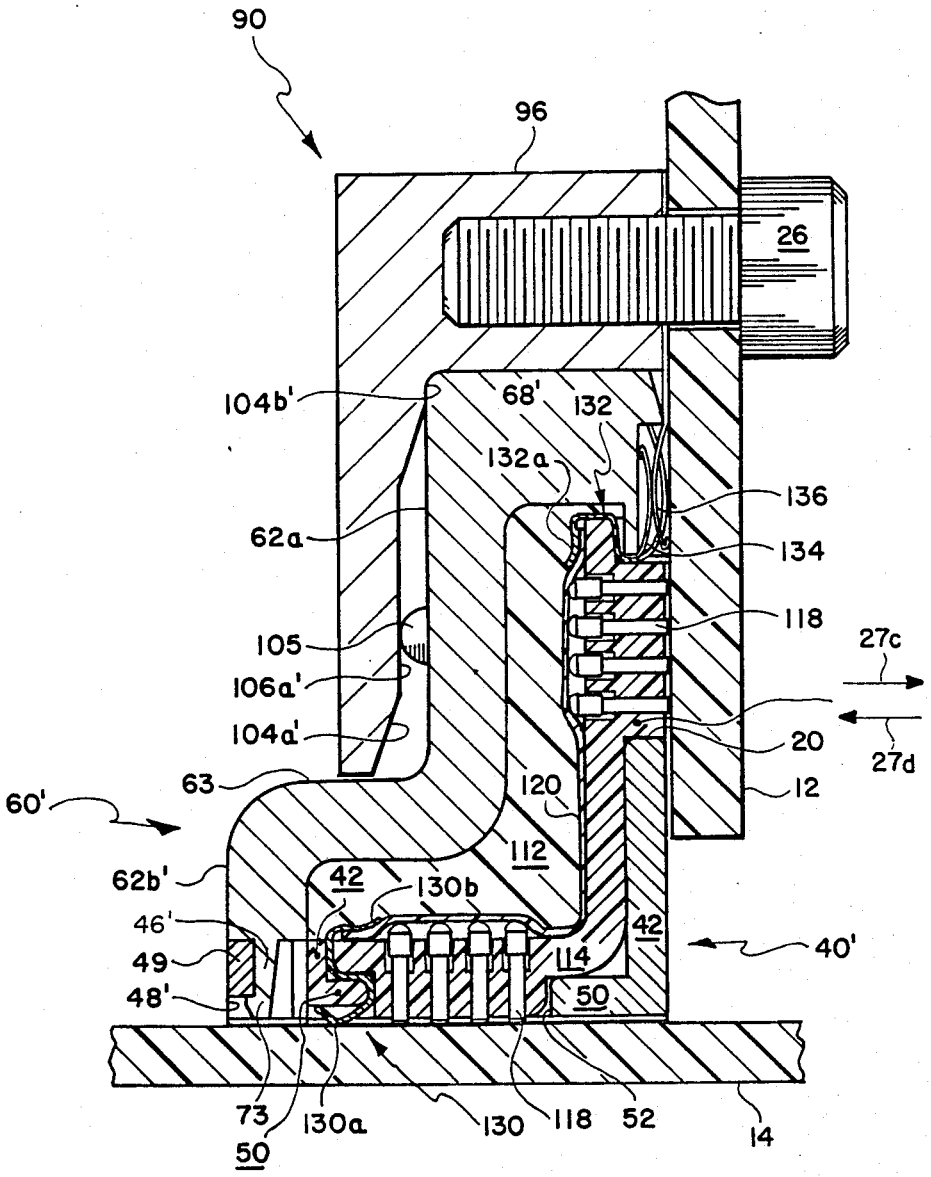
FIG. 4B is a cross-sectional view of the alternative embodiment of the high density backplane connector in a mated condition.

An alternative embodiment for a housing module 16' is depicted in FIGS. 4A, 4B. The inventors have determined that in some applications expansion reaction forces have a tendency to cause the top wall 68 of the housing module 16 of the embodiment of FIGS. 3A, 3B to bow. The configuration of the upper section 60' of FIGS. 4A and 4B provides increased mechanical rigidity in the topwall 68'. In addition, an alternative means for mating the lower and upper sections 40', 60' of the housing module 16' is described.

The lower section 40' of the housing module 16' has a configuration as generally described hereinabove with the exception that each of the holes 48' are formed in the mating tabs 46 to include an engaging lip 49.

The upper section 60' of the housing module 16' has a configuration as generally described hereinabove except for the following modifications. The top wall 68' of the upper section 60' has a reduced width which increases the mechanical rigidity thereof.

The sidewall 62' of this embodiment is formed as parallel, offset sidewalls **62*a'*, 62*b'* which are structurally interconnected by a lateral wall 63. The complimentary camming member 74' is integrally formed on the sidewall 62*a'*. The mating recesses 70' formed in the sidewall 62*b'* having latching tabs 73 formed therein rather than the bores 72**.

Referring to FIGS. 2, 3A, 3B, 4A, 4B, the compliant contact module 110 according to the present invention includes a resilient member 112, an insulator member 114 having a first and second plurality of contact slots 116, 116 formed therethrough, a first and second plurality of rigid contact pins 118, 118 and a flexile film 120. The resilient member 112 is formed from an elastomer such as silicone rubber or other such resilient material. The resilient member 112 has registration holes 113 (see FIG. 3A) formed therethrough and is configured to be mounted within the compliant contact module chamber 18. The resilient member 112 is designed for resilient deformation as the housing module 16 is secured to the motherboard 14 and as the daughterboard 12 is mated to the motherboard.

The insulator member 114 has a generally L-shaped configuration and includes first and second protruding portions **114*a*, 114*b* sized to fit within the motherboard window 52 and the daughterboard window 20, respectively. Registration holes 115 are formed through the insulator member 114 (FIG. 2). The first and second plurality of contact slots 116, 116 are formed in the insulator member 114 such that first ends thereof interface with the motherboard window 52 and the daughterboard window 20, respectively, while the second ends interface with the flexile film 120. The geometric patterns of the contact slots 116 correspond to the contact interconnect patterns of the daughterboard 12 and the motherboard 14**, respectively.

Each of the first and second plurality of rigid contact pins 118, 118 have a configuration which includes a head portion 118*a*and a tail portion 118*b*. The first and second plurality of contact pins 118, 118 are disposed in corresponding first and second plurality of contact slots 116, 116 so that the head portions 118*a* interface with the flexile film 120 and the tail portions 118*b* interface with corresponding contact interconnects of the daughterboard 12 and motherboard 14, respectively. The configurations and dimensions of the contact slots 116 and the rigid contact pins 118 are selected such that the contact pins 118 are free-floating within the contact slots 116, i.e., capable of bidirectional linear movement as represented by arrows *27a, 27b, 27c, 27d* over a predetermined limited range.

The flexile film 120 is fabricated from a resilient dielectric material and is interposed between the resilient member 112 and the insulator member 114 for movement generally in the directions of arrows *27a, 27b* and *27c, 27d,* respectively. Heat-resistant polymers such as polyimides are a representative dielectric having excellent electrical properties and which are readily formable into thin, bendable flexile films. Registration holes 121 are formed through the flexile film 120.

Figure 5C:
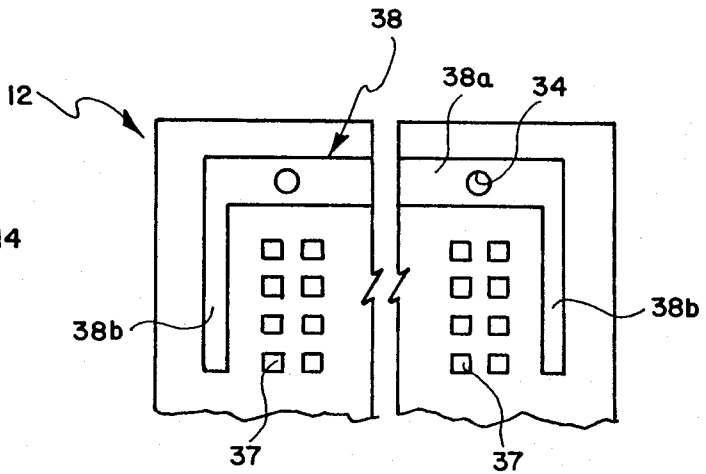
FIG. 5C is a plan view of a geometric conductive pattern of a daughterboard.
Figure 5B:
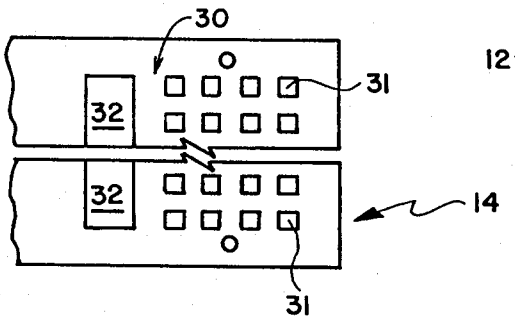
FIG. 5B is a plan view of a geometric conductive pattern of a motherboard.
Figure 5A:
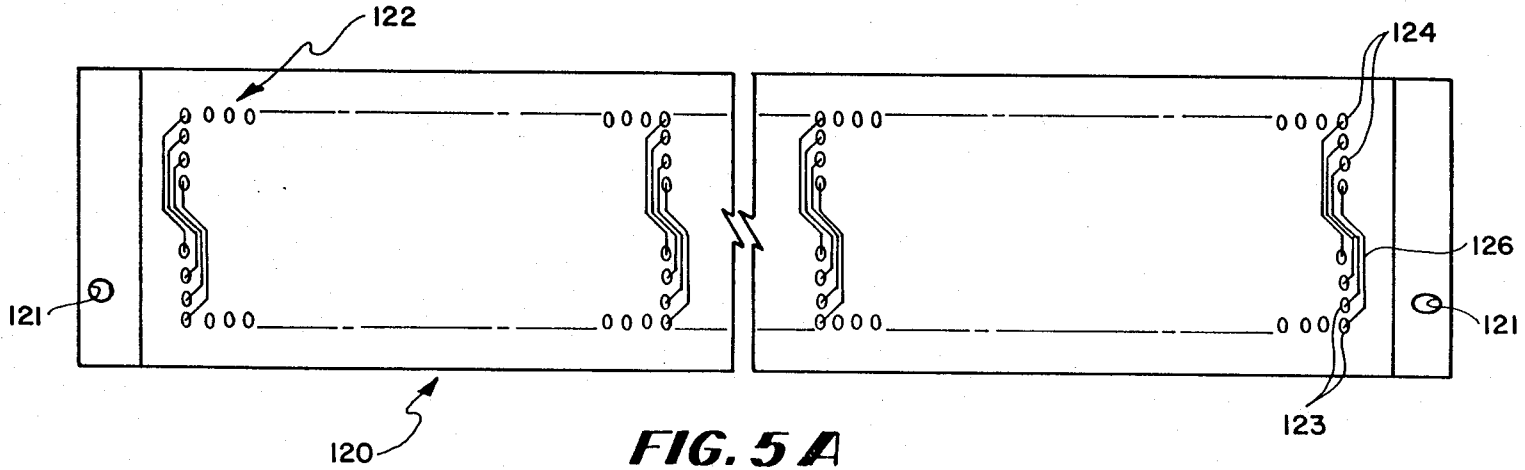
FIG. 5A is a plan view of a conductive matrix formed on a flexile film.

As exemplarily illustrated in FIG. 5A a conductive matrix 122 is formed on one major surface of the flexile film 120 and includes first and second contact interconnects 123, 124 and interconnecting conductive traces 126 therebetween. The conductive matrix 122 according to the present invention is utilized only for signal and power interconnections between the motherboard 14 and the daughterboard 12. The conductive matrix 122 is formed from electrically conductive material such as electrolytic plated copper by conventional photolithographic methods.

The geometric pattern of the first array of contact interconnects 123 corresponds to the geometric pattern of the 9 contact interconnects formed on the motherboard 14. As shown in FIG. 5B, the motherboard 14 includes an array of contact interconnects 31 and a ground strip 32 forming a predetermined geometric conductive pattern 30. Likewise, the geometric pattern of the second array of contact interconnects 124 corresponds to the geometric pattern of the contact interconnects formed on the daughterboard 12. As shown in FIG. 5C, the daughterboard 12 includes an array of contact interconnects 37 and a U-shaped ground bus 38 including a center ground strip 38*a* and two ground legs 38*b* which form a predetermined geometric conductive pattern 36. As may be seen by an examination of FIGS. 3A and 4A, the ground legs 38*b* are prestressed to bow outwardly from the mating surface of the daughterboard 12.

The conductive matrix 122 of the present invention provides a contact interconnect spacing of 80 contact interconnects per linear inch. For the particular application discussed hereinabove wherein 300 signal interconnects were required, the conductive matrix 122 of the present invention requires only a total of 350 contact interconnect (300 signal interconnects, 50 power interconnects). Assuming only a single row of 350 signal/-power contact interconnect, the conductive matrix 122 of the present invention requires approximately 4.375 linear inches of space. This represents an approximate 65% and 30% reduction, respectively, in linear space over prior art electrical connectors. This reduction in linear spacing represents a corresponding available increase in I/O density. By way of illustration only, the arrays of contact interconnects 123, 124 are typically arranged in a 0.050" by 0.050" square grid.

A ground plane 128 is formed on the other major surface of the exemplary flexile film 120 of FIG. 5A. The ground plane 128 is formed from electrically conductive material such as electrolytic plated copper by conventional plating methods.

The compliant contact module 110 further includes a first ground strip 130 and a second ground strip 132. The first ground strip 130 is formed from an electrically conductive material to have a generally S-shaped configuration with first and second resilient ends 130*a*, 130*b*. The first resilient end 130*a* is adapted to mechanically and electrically engage the ground plane 128 of the flexile film 120. The second resilient end 130*b* is adapted to mechanically and electrically engage the ground strip 32 of the motherboard 14.

The second ground strip 132 is formed from an electrically conductive material to have a generally S-shaped configuration with a first resilient end 132*a* adapted to mechanically and electrically engage the ground plane 128 of the flexile film 120. The other end of the ground strip 132 is discontinuous and is formed to have two prestressed early-mate ground contacts 134 and a plurality of distributed resilient ground contacts 136. The prestressed early-mate ground contacts 134 and the resilient ground contact 136 are adapted to mechanically and electrically sequentially engage the ground legs 38*b* and the center ground strip 38*a*, respectively, of the U-shaped ground bus 38 of the daughterboard 12.

To assemble and secure the housing module 16 of FIGS. 3A, 3B to the motherboard 14, the registration pins 22 are inserted into the registration holes 54 of the lower section 40. The compliant contact module 110 is mounted in the lower section 40 by interfacing the insulator member 114 with the support shoulder 50 with the registration pins 22 inserted through the corresponding registration holes 115, 121, 113 of the insulator member 114, the flexile film 120 and the resilient member 112, respectively. With the compliant contact member 110 interfaced with the lower section 40, the first protruding portion 114*a* is interfaced with the motherboard window 52.

The housing module 16 is assembled by inserting the mating recesses 70 of the upper section 60 onto corresponding mating tabs 46 of the lower section 40, with the registration pins 22 being inserted into registration bores 78. The lower section 40 and the upper section 60 are secured together by mating screws 24 disposed through the holes 48 and threaded into the bores 72. The second protruding portion 114*b* is interfaced with the daughterboard window 20.

With the housing module 16 in an assembled configuration, the resilient member 112 exerts a biasing force on the first and second plurality of rigid contact pins 118, 118 through the flexile film 120 such that corresponding contact pins 118 protrude outwardly from the daughterboard window 20 (direction *27c*, FIG. 3A) and the motherboard window 52 (direction *27a*, FIG. 3A). The first groundstrip 130 is pressfit between the insulator member 114 and one sidewall 42 and the support shoulder 50 of the lower section 40 wherein the first resilient end 130*a* mechanically and electrically engages the ground plane 128. The first resilient end 132*a* of the second groundstrip 132 is pressfit between the insulator member 114 and the edge of the top wall 68 of the upper section 60 to mechanically and electrically engage the ground plane 126.

The prestressed early-mate ground contacts 136 are disposed in the contact channels 84 of the upper section 60. The resilient ground contacts 134 abut the edge of the top wall 68 subjacent the overhang 82.

The housing module 16 is secured to the motherboard 14 by inserting the registration pins 22 into corresponding pilot holes 28 (see FIG. 4B) in the motherboard 14 to interface the lower section 40 with the motherboard 14. Securing screws 26 are then inserted through securing apertures (not shown) in the motherboard 14 from the underside thereof into engagement with the securing bores 80 of the upper section 60 to secure the housing module 16 to the motherboard 14.

With the housing module 16 secured to the motherboard 14, the tail portions **118*b* of the first plurality of rigid contact pins 118 are mechanically and electrically engaged with corresponding contact interconnects 31 of the motherboard 14. The mechanical engagement causes the first plurality of rigid contact pins 118 to be biased in the direction 27*b* to produce corresponding flexile movement in the flexile film 120 and resilient compression in the resilient member 112. The reactive force exerted by the resilient member 112 (direction 27*a*) causes good mechanical and electrical contact to be maintained between the contact interconnects 31 and the rigid contact pins 118. The second resilient end 130*b* of the first groundstrip 130 mechanically and electrically engages the groundstrip 32 of the motherboard 14**.

Mating of the daughterboard 12 (with stiffener module 90 secured thereto as described hereinabove) to the motherboard 14 (with the housing module 16 secured thereto as described hereinabove) by means of the HDB connector 10 embodiment of FIGS. 3A, 3B is effected by initially pressing the stiffener module 90 downwardly over the housing module 16 wherein the planar engaging surface **106*a* slidingly translates over the sidewall 62 of the upper section 60. As the stiffener module 90 is progressively moved downwardly over the housing module 16, the prestressed early-mate ground contacts 134 sequentially engage the daughterboard 12 and the bowed ground legs 38*b***, respectively.

The early-mate ground contacts 134 exert a biasing force against the daughterboard 12 to displace the daughterboard 12 in the direction **27*c*. The daughterboard 12 is sufficiently displaced in the direction 27*c* such that the tail portions 118*b* of the second plurality of rigid contact pins 118 move past noncorresponding contact pads 37 of the daughterboard 12** with no mechanical engagement therebetween.

Further downward movement of the stiffener module 90 causes the first and second tapered camming surfaces **104*a*, 104*b* thereof to mechanically engage the complimentary camming member 74 and upper edge of the sidewall 62, respectively. The camming coaction between these elements is sufficient to overcome the biasing force exerted by the prestressed early-mate ground contacts 134, thereby causing the daughterboard 12 to be displaced in the direction 27*d***.

Displacement of the daughterboard 12 in direction **27*d* brings the tail portions 118*b* of the second plurality of rigid contact pins 118 into mechanical engagement with the corresponding contact interconnects 37 of the daughterboard 12. Concomitantly, the plurality of distributed resilient ground contacts 136 mechanically engage the center ground strip 38*a* of the daughterboard 12**.

A final very small downward displacement of the stiffener module 90 in the direction **27*a* completes the mating process. The final small downward displacement effects a wiping action between the tail portions 118*b* of the second plurality of rigid contact pins 118 and the corresponding contact interconnects 37 of the daughterboard 12. The small downward displacement also effects a wiping action between the plurality of distributed resilient ground contacts 136 and the center ground strip 38*a* of the daughterboard 12**. The wiping actions ensure good electrical interconnections between the corresponding elements. By way of example only, a wiping action of approximately 0.020 inches is effected by the final small downward displacement.

During the initial phase of the mating process, the alignment post 102 of the stiffener module 90 is slidably received in the alignment slot 86 of the upper section 60 to ensure correct registration between the second array of rigid contact pins 118 and the contact interconnects 37 of the daughterboard 12. The overhang 82 of the upper section 60 precludes inadvertent mechanical engagement between the distributed resilient ground contacts 136 and the daughterboard 12 during the initial phase of the mating process.

FIG. 3B illustrates the completed mechanical and electrical interconnection between the daughterboard 12 and the motherboard 14. The first and second engaging surfaces **106*a*, 106*b* mechanically engage the complimentary camming member 74 and upper edge of the sidewall 62, respectively. The biasing forces exerted by the prestressed early-mate groud contacts 134 cause reactive forces to be exerted orthogonally through the complimentary camming member 74 and upper edge of the sidewall 62 against the first and second engaging surfaces 106*a*, 106*b*, respectively. These forces maintain the daughterboard 12 and motherboard 12** in secured mating engagement.

The interaction between the first and second engaging surfaces **106*a*, 106*b* and the complimentary camming member 74 and upper edge of the sidewall 62 preclude relative rotational movement between the motherboard 14 and the daughterboard 12. This interaction also precludes the daughterboard 12 from "walking away" from the tail portions 118 of the second plurality of rigid contact pins 118**.

The housing module 16' of FIGS. 4A, 4B is assembled and mated to the motherboard 14 as described hereinabove except that the housing module 16' is assembled by inserting the mating tabs 46' of the lower section 40' in corresponding mating recesses 70' of the upper section 60'. The lower and upper sections 40', 60' are secured together by the snap-fit engagement of the latching tabs 73 with corresponding engaging lips 49.

Mating of the daughterboard 12 (with stiffener module 90' secured thereto as described hereinabove) to the motherboard 14 (with the housing module 16' secured thereto as described hereinabove) by means of the HDB connector 10 embodiment of FIGS. 4A, 4B is generally accomplished as described hereinabove. FIG. 4B illustrates the completed mechanical and electrical interconnection between the daughterboard 12 and the motherboard 14. The biasing forces exerted by the prestressed early-mate ground contacts 134 cause reactive forces to be exerted orthogonally as described hereinabove to maintain the daughterboard 12 and motherboard 14 in secured mating engagement.

The HDB connector of the present invention provides the capability of electrically interconnecting printed circuit boards having a high density of input-/output contact interconnects. The modular elements of the HDB connector are of relatively straightforward design, thereby facilitating the ease and cost of manufacturing by conventional methods. The HDB connector is independent of printed circuit board thicknesses and variations in tolerances. Moreover, the modular elements are easily resized to facilitate use thereof with printed circuit boards of varying dimensions. 1 The HDB connector of the present invention does not require a separate and/or complex camming mechanism. The camming elements of the HDB connector are readily formed as integral elements of the compliant contact module, the stiffener module and the upper section of the housing module. The camming elements of the HDB connector provide a wiping action between interconnecting conductive elements, provides a sequential mating capability, and requires only a low insertion force to effect mating between printed circuit boards. The inherent simplicity and operation of the camming elements greatly increases the reliability of the HDB connector.

The compliant contact module is assembled with preloaded rigid contact pins which facilitates the assemblage thereof. The preloaded contact pins are free-floating and coact orthogonally with the contact interconnects formed on the flexile film. Orthogonal coaction substantially eliminates any the possibility of any erosion and/or abrasion damage of the contact interconnects of the flexile film thereby maintaining signal path integrity and impedance matching. The conductive matrix and the ground plane are readily formed as continuous circuit paths on the flexile film to ensure precise impedance matching for printed circuit board interconnects. These features in conjunction with the distributed ground contacts provide for enhanced electrical performance of the HDB connector.

A variety of modifications and variations of the present invention are possible in light of the above teachings. It is therefore to be understood that, within the scope of the appended claims, the present invention may be practiced otherwise than as specifically described hereinabove.

What is claimed is:

1. A high density backplane connector for mating and electrically interconnecting first and second high density circuit boards having predetermined geometric conductive patterns, comprising:

compliant contact module means for electrically interconnecting the first and second high density circuit boards, said compliant contact module means including compliant means for providing a conductive matrix and biasing forces to electrically interconnect the first and second high density circuit boards, first contact means coacting with said compliant means for electrically interconnecting said conductive matrix to the predetermined geometric conductive pattern of the first high density circuit board, and second contact means coacting with said compliant means for electrically interconnecting said conductive matrix to the predetermined geometric conductive pattern of the second high density circuit board, said second contact means including biasing means for mechanically and electrically engaging the predetermined geometric conductive pattern of the second high density circuit board and for exerting a biasing force against the second high density circuit board for displacement thereof away from said compliant contact module means during initial mating;

stiffener module means secured to the second high density circuit board for providing a camming force sufficient to overcome said biasing force exerted by said biasing means wherein said second contact means is mechanically and electrically engaged with the predetermined geometric conductive pattern of the second high density circuit board with a wiping action therebetween during mating; and housing module means secured to the first high density circuit board for mounting said compliant contact module means therein and wherein said compliant means biases said first contact means into mechanical and electrical engagement with the predetermined geometric conductive pattern of the first high density circuit board, said housing module mean including camming means for coacting with said stiffener module means to provide said camming force during mating; and wherein mating of the second high density circuit board to the first high density circuit board is effected by pressing said stiffener module means downwardly over said housing module means to sequentially cause said biasing means to engage the second high density circuit board, said stiffener module means cammingly coacts with said camming means of said housing module means to cause said second contact means to mechanically and electrically engage the predetermined geometric conductive pattern of the second high density circuit board, and said second contact means coacts with the predetermined geometric conductive pattern of the second high density circuit board to effect a wiping action therebetween.

2. The high density backplane connector of claim 1 wherein said stiffener module means comprises a top wall, first and second endwalls structurally depending from said top wall and a sidewall structurally depending from said topwall, an inner surface of said sidewall having a first tapered camming surface, a first engaging surface contiguous with said first tapered camming surface, a second tapered camming surface contiguous with said first engaging surface and a second engaging surface contiguous with said second tapered camming surface, and wherein said first tapered camming surface, said first engaging surface, said second tapered camming surface and said second engaging surface sequentially coact with said camming means of said housing module means to provide said camming force.

3. The high density backplane connector of claim 1 wherein said housing module means comprises a lower section having means for securing said housing module means to the first high density circuit board; and an upper section;

said upper and lower sections including complementary means for mating said upper and lower sections together to form said housing module means; and wherein said camming means is a complimentary camming member integrally formed as part of said upper section to coact with said stiffener module means to provide said camming force to overcome said biasing force exerted by said biasing means wherein said second contact means is mechanically and electrically engaged with the predetermined geometric pattern of the second high density circuit board.

4. The high density backplane connector of claim 3 wherein said lower section includes first and second sidewalls, first and second endwalls structurally disposed between said first and sidewalls, and a support member projecting inwardly from said first and second sidewalls and endwalls and adapted for mounting said compliant contact module means, an inner periphery of said support member defining a motherboard window wherein said first contact means interfaces with the first high density circuit board, said upper section including a top wall, first and second endwalls structurally depending from said top wall and at least one sidewall structurally depending from said top wall, and wherein said complimentary camming member is integrally formed on said at least one sidewall, and further wherein said upper and lower sections in mated combination define a daughterboard window wherein said second contact means interfaces with the second high density circuit board.

5. The high density backplane connector of claim 4 wherein said at least one sidewall includes a first sidewall depending from said top wall and a second sidewall substantially parallel to said first sidewall and structurally interconnected therewith by a lateral wall, and wherein said complimentary camming member is integrally formed on said first sidewall.

6. The high density backplane connector of claim 1 wherein said compliant means includes a flexile film having first and second major surfaces, and wherein said conductive matrix is formed on said first major surface and includes a first array of contact interconnects corresponding to signal and voltage contact interconnects of the predetermined geometric conductive pattern of the first high density circuit board, a second array of contact interconnects corresponding to signal and voltage contact interconnect of the predetermined geometric conductive pattern of the second high density circuit board, and conductive traces interconnecting said first array of contact interconnects and said second array of contact interconnects, and further wherein a ground plane is formed on said second major surface; and a resilient member for providing said biasing forces engagingly disposed with said second major surface of said flexile film.

7. The high density backplane connector of claim 6 wherein said compliant contact module means further includes insulator member means engagingly disposed with said first major surface of said flexile film for mounting said first and second contact means in predetermined relation to the first and second high density circuit boards, respectively.

8. The high density backplane connector of claim 7 wherein said first contact means includes a first plurality of rigid contact pins mounted in said insulator member means to be bidirectionally free-floating and wherein said second contact means includes a second plurality of rigid contact pins mounted in said insulator member means to be bidirectionally free-floating, and wherein said compliant means coacts with said first and second plurality of rigid contact pins to provide biasing forces thereagainst.

9. The high density backplane connector of claim 8 wherein said first contact means further includes a ground strip having first and second ends, said second end of said ground strip mechanically and electrically engaging said ground plane of said flexile film and said first end of said ground strip mechanically and electrically engaging a ground strip of the predetermined geometric conductive pattern of the first high density circuit board.

10. The high density backplane connector of claim 8 wherein said second contact means further includes a ground strip having first and second ends, said first end of said ground strip mechanically and electrically engaging said ground plane of said flexile film, and wherein said second end of said ground strip includes a plurality of distributed resilient ground contacts for mechanically and electrically engaging a center ground strip of the predetermined geometric conductive pattern of the second high density circuit board, and a pair of spaced-apart, prestressed early-mate ground contacts for mechanically and electrically engaging corresponding ground legs of the predetermined geometric conductive pattern of the second high density circuit board, and wherein said pair of spaced-apart, prestressed early-mate ground contacts are said biasing means.

* * * * *

UNITED STATES PATENT AND TRADEMARK OFFICE

CERTIFICATE OF CORRECTION

PATENT NO. : 4,881,901

DATED : November 21, 1989

INVENTOR(S) : David W. Mendenhall, et al.

It is certified that error appears in the above-identified patent and that said Letters Patent is hereby corrected as shown below:

Column 1, line 4, the title appears twice, delete the second occurrence of "HIGH DENSITY BACK PLANE CONNECTOR".

Column 4, line 58, "DETAILED DESCRIPTION OF PREFERRED EMBODIMENT" should read --DETAILED DESCRIPTION OF PREFERRED EMBODIMENTS--.

Column 6, line 29, "tabs 46" should read --tabs 46'--.

Column 7, line 5, "portion 118aand" should read --portion 118a and--.

Column 10, line 33, "early-mate groud" should read --early-mate ground--.

Column 10, line 60, "connector 10" should read --connector 10'--.

Column 11, line 11, "1 The HDB" should read --The HDB--.

Signed and Sealed this

Thirtieth Day of March, 1993

*Attest:*

STEPHEN G. KUNIN

*Attesting Officer*

*Acting Commissioner of Patents and Trademarks*